US009199295B2

(12) United States Patent
Holbrook

(10) Patent No.: US 9,199,295 B2
(45) Date of Patent: Dec. 1, 2015

(54) ROLLER SWAGE METHOD AND APPARATUS

(75) Inventor: Michael L. Holbrook, Port Townsend, WA (US)

(73) Assignee: THE BOEING COMPANY, Chicago, IL (US)

( * ) Notice: Subject to any disclaimer, the term of this patent is extended or adjusted under 35 U.S.C. 154(b) by 512 days.

(21) Appl. No.: 13/607,858

(22) Filed: Sep. 10, 2012

(65) Prior Publication Data

US 2014/0069159 A1 Mar. 13, 2014

(51) Int. Cl.

| | |
|---|---|
| ***B21D 39/04*** | (2006.01) |
| ***B21D 17/04*** | (2006.01) |
| *B21D 39/14* | (2006.01) |
| *B21D 39/10* | (2006.01) |

(52) U.S. Cl.

CPC ..... *B21D 17/04* (2013.01); *B21D 39/046* (2013.01); *B21D 39/10* (2013.01); *B21D 39/14* (2013.01)

(58) Field of Classification Search

CPC ..... B21D 17/04; B21D 39/046; B21D 39/08; B21D 39/10; B21D 39/14; B21D 39/18; Y10T 29/49863

USPC ..... 72/43, 122, 113, 117, 75, 78, 112, 120, 72/123–126; 29/505–515, 521, 522.1, 29/523–525, 516, 517

See application file for complete search history.

(56) References Cited

U.S. PATENT DOCUMENTS

| | | | | |
|---|---|---|---|---|
| 260,555 | A | | 7/1882 | Ferguson |
| 1,007,017 | A | | 10/1911 | Wiedeke |
| 3,311,971 | A | | 4/1967 | Hicks et al. |
| 3,438,657 | A | | 4/1969 | Torres |
| 3,648,500 | A | * | 3/1972 | Vaill ..... 72/71 |
| 3,727,443 | A | | 4/1973 | Quinlan |
| 3,762,204 | A | * | 10/1973 | Socier ..... 72/316 |
| 4,641,407 | A | | 2/1987 | Blevins et al. |
| 4,658,616 | A | | 4/1987 | Bastone |

(Continued)

FOREIGN PATENT DOCUMENTS

| | | |
|---|---|---|
| DE | 519436 | 2/1931 |
| GB | 1076661 | 7/1967 |
| WO | 02/02255 | 1/2002 |

OTHER PUBLICATIONS

International Search Report and Written Opinion, International Application No. PCT/US2013/049254 (Sep. 25, 2013).

(Continued)

*Primary Examiner* — Peter DungBa Vo
*Assistant Examiner* — Joshua D Anderson
(74) *Attorney, Agent, or Firm* — Robert Slenker

(57) ABSTRACT

An apparatus for roller swaging may include a support arm, a spherical roller rotatably supported in the support arm, a mount for slidably supporting the support arm, a first actuator for displacing the support arm relative to the mount, a second actuator for supporting the arm and imparting rotational movement of the mount about an axis in which the spherical roller describes a circular path, a base for supporting the second actuator for reciprocal movement parallel to the axis, and a third actuator connected to the second actuator for displacing the second actuator relative to the base. A method for roller swaging may include inserting a tube end into a ferrule, and urging a spherical roller against an inner wall of the tube with a force sufficient to swage the inner wall against the ferrule, thereby mechanically securing the ferrule to the end of the tube.

19 Claims, 3 Drawing Sheets

(56) References Cited

U.S. PATENT DOCUMENTS

| | | | | |
|---|---|---|---|---|
| 5,454,152 | A | 10/1995 | Hosseinian | |
| 5,802,900 | A * | 9/1998 | Lee | 72/75 |
| 6,286,213 | B1 * | 9/2001 | Hada et al. | 29/890.044 |
| 6,390,124 | B1 | 5/2002 | Kido et al. | |
| 6,843,096 | B2 | 1/2005 | Viegener et al. | |
| 7,836,741 | B2 * | 11/2010 | Johnston | 72/117 |
| 7,918,006 | B2 * | 4/2011 | Brayman | B23P 11/025 285/332 |
| 7,987,690 | B2 * | 8/2011 | Duggan et al. | 72/370.03 |
| 8,056,208 | B2 * | 11/2011 | Karoliussen | 29/523 |
| 8,777,277 | B2 * | 7/2014 | Dole et al. | 285/367 |
| 2012/0167372 | A1 | 7/2012 | Spink | |
| 2013/0055780 | A1 * | 3/2013 | Novitsky et al. | 72/117 |

OTHER PUBLICATIONS

English translation of DE 519436 (published Feb. 12, 1931).
English translation of WO 02/02255 (published Jan. 10, 2002).

* cited by examiner

ROLLER SWAGE METHOD AND APPARATUS

BACKGROUND

The present disclosure relates to methods and apparatus for swaging, and more particularly, to methods and apparatus for roller swaging.

Current swaging devices and methods, in particular those used to swage a ferrule on the end of a tube, may utilize one or more tapered rollers. A cylindrical metal ferrule having a series of annular grooves formed on an inner wall may be inserted over the end of a metal tube. A plurality—typically three—tapered rollers may be inserted in the end of the tube and urged radially outwardly toward the inner wall of the tube. The tapered rollers then may be rotated in a circular pattern along the inner wall of the tube. With this circular motion, the tapered rollers may be urged radially outwardly with sufficient force to deform the metal of the tube radially outward and into the grooves of the ferrule.

A disadvantage that may be associated with this type of swaging is that, because most of the material flow caused by the tapered rollers is in a direction not in line with the applied force (i.e., radially outward), the cylindrical rollers require a relatively large torque. The large torque also may be required because the cylindrical rollers are inserted into the tube such that they deform the metal of the tube to fill all of the grooves of the ferrule at the same time.

Such relatively large applied forces may create an unacceptable deformation of the ferrule when the tube is swaged into the ferrule. The resulting swaged ferrule and/or tube end may be out of round. Another disadvantage with this process is that a given swaging head having tapered rollers may be usable for swaging ferrules on tubes having only a limited range of diameters and wall thicknesses. It is therefore necessary to maintain an inventory of different swaging heads having different tapered rollers of different sizes. Accordingly, there is a need for a method and apparatus for roller swaging that reduces the amount of energy required to perform the swaging process, minimizes any deformation of the ferrule and tube, and does not require different tooling for different sizes and thicknesses of ferrules and tubes.

SUMMARY

The present disclosure is directed to a roller swage method and apparatus that requires less energy to perform a swaging operation than prior art methods and devices, deforms the work pieces less than prior art methods and devices, and in which a single tool may be used to swage a variety of work pieces of different thicknesses and diameters. In one embodiment, an apparatus for roller swaging may include a support arm, a spherical roller rotatably supported in the support arm, a mount for slidably supporting the support arm, a first actuator for displacing the support arm relative to the mount, and a second actuator for supporting the mount and imparting rotational movement of the mount about a central axis in which the spherical roller describes a circular path.

In another embodiment, an apparatus for roller swaging may include a clamp adapted to hold a ferrule having a grooved interior surface fitted over an end of a tube, a support arm extending in a direction parallel to an axis passing through the center of the ferrule, a spherical roller rotatably supported in the support arm, a mount adapted to receive the support arm for relative slidable movement in a radial direction relative to the axis, a first actuator for displacing the support arm relative to the mount, a second actuator for supporting the mount and imparting rotational movement of the mount about a central axis in which the spherical roller describes a circular path, a base for supporting the second actuator for reciprocal movement parallel to the axis, a third actuator connected to the second actuator for displacing the second actuator relative to the base, and a controller.

In an embodiment, the controller may be configured to operate the first actuator, second actuator and third actuator in a sequence in which the third actuator displaces the second actuator to place the support arm into the ferrule and align the spherical roller with a first groove in the ferrule, then the first actuator displaces the support arm radially outward from the axis such that the spherical roller deforms a portion of the tube and into the first groove. The second actuator then rotates the arm such that the spherical roller displaces the portion of the tube and along the first groove. The controller then activates the first actuator to displace the support arm radially inward toward the axis, then activates the third actuator to displace the second actuator to align the spherical roller with a second groove of the ferrule to repeat the sequence.

In yet another embodiment, a method of roller swaging may include inserting an end of a tube into a ferrule, and urging a spherical roller against an inner wall of the tube with a force sufficient to swage the inner wall against the ferrule and thereby mechanically secure the ferrule to the end of the tube. In another aspect of that embodiment, a method for roller swaging may include inserting an end of a metal tube into a ferrule, the ferrule having at least one annular groove formed in an inner surface thereof, positioning a spherical roller radially inward of the annular groove and an inner wall of the tube relative to a center of the ferrule, and simultaneously urging the spherical roller radially outward against the inner wall of the tube with a force sufficient to deform the tube into the annular groove, and moving the spherical roller in a circular path, whereby a portion of the tube is deformed into substantially an entirety of the length of the annular groove.

Other objects and advantages of the disclosed roller swage method and apparatus will be apparent from the following description, the accompanying drawings and the appended claims.

DETAILED DESCRIPTION

Figure 1:
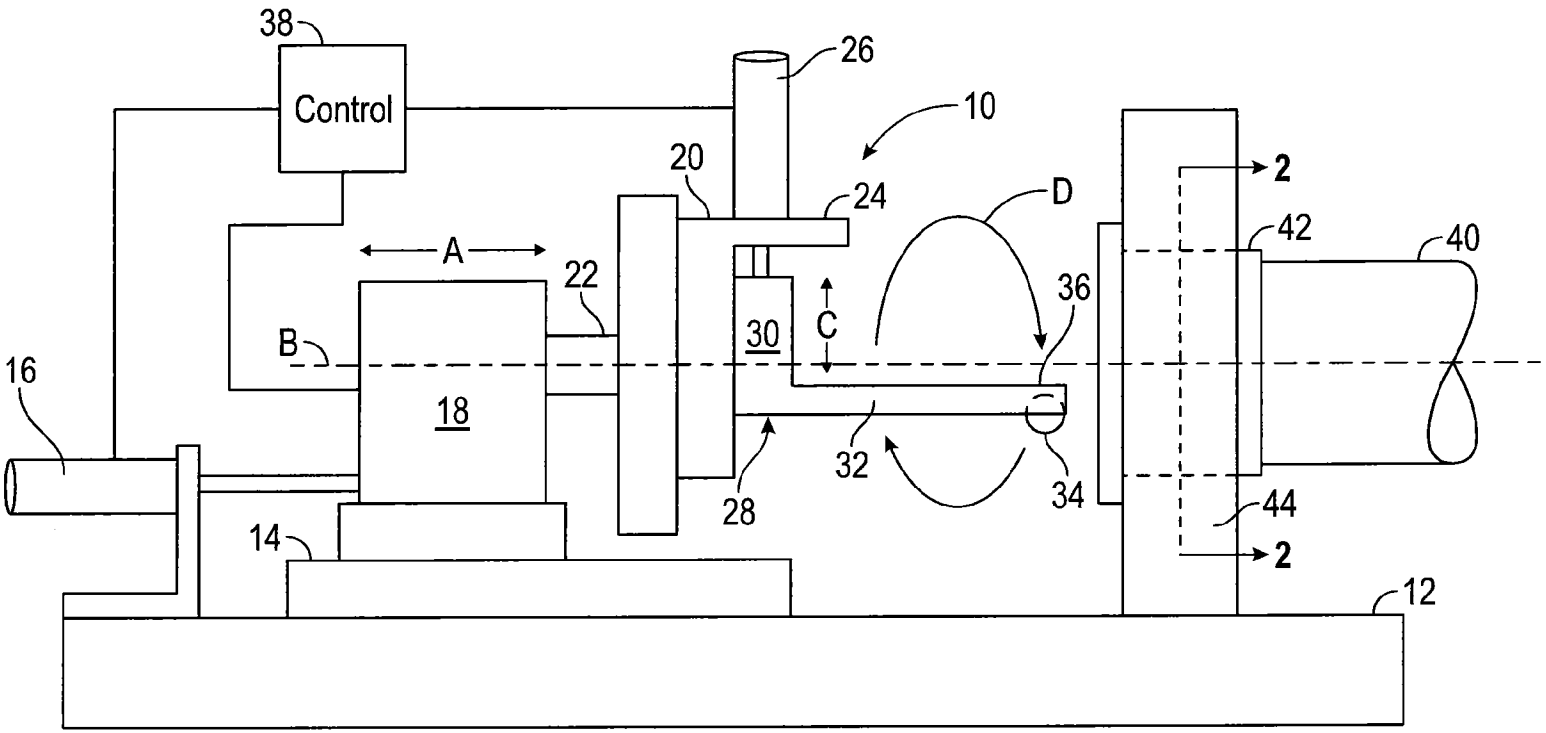
FIG. 1 is a side elevation of the disclosed roller swage apparatus.

As shown in FIG. 1, the roller swage apparatus, generally designated 10, may be mounted on a base 12. The roller swage 10 may include a linear slide 14 and an actuator 16, both mounted on the base 12. The actuator 16 may be connected to an actuator 18 that may be mounted on the slide 14, so that the actuator 16 may displace the actuator 18 on the slide in the direction of arrow A in a linear direction. The actuator 18 may support a mount 20 by way of an axle 22 that lies along a central axis of rotation B. Mount 20 may include a horizontal arm 24 that supports an actuator 26. Actuator 26 may be connected to support arm 28, which may be attached to mount 20 by way of a slide that allows the support arm to move in a vertical direction denoted by arrow C in FIG. 1, which is a radial direction relative to the central axis of rotation B. Support arm 28 may include a radial component 30 and an axial component 32, the latter of which may extend in a direction parallel to axis B.

A spherical roller 34 may be mounted in a spherical recess 35 (see FIG. 4) in an end 36 of the axial component 32 of the support arm 28 at a location distal from the mount 20. Recess 35 may allow roller 34 to have a 360° freedom of movement. Roller 34 may be made of a hard material, such as titanium or stainless steel. In an embodiment, the roller 34 may have a diameter of 0.25 inches.

As shown in FIG. 1, the apparatus 10 may include a control 38 that may be a computer or programmable logic controller connected to activate actuators 16, 18 and 26. Actuators 16 and 26 are shown in FIG. 1 as double-acting cylinder motors. However, it is within the scope of this disclosure to provide actuators 16 and 26 in the form of ball screws, rack and pinion drives, linear actuators and other well-known devices for imparting linear, reciprocal motion. Actuator 18 may be a direct current motor, an alternating current motor, a stepper motor, or a hydraulic motor. Actuator 18 may be any known device that imparts a rotational motion to axle 22 that rotates support arm 28 in a circular path denoted by arrow D so that spherical roller 34 describes a circular path about axis B.

Figure 2:
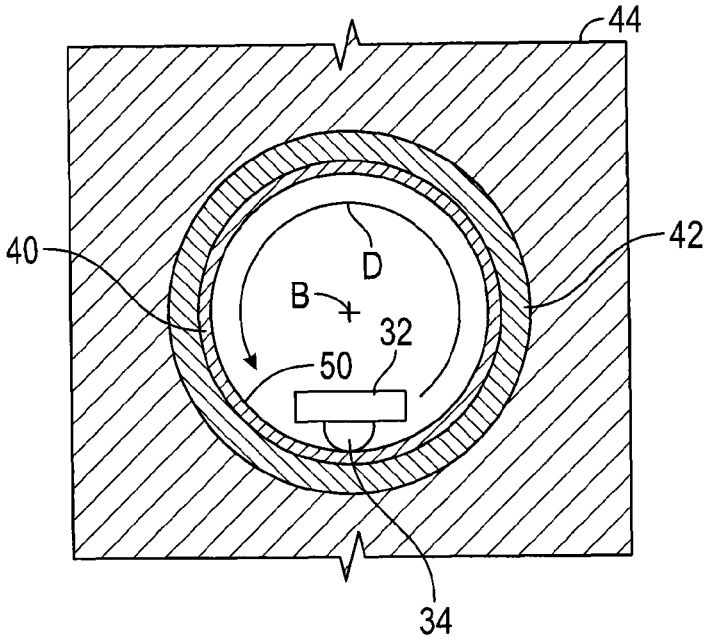
FIG. 2 is a detail in section taken at line 2-2 of FIG. 1.

Also as shown in FIG. 1, a tube 40 may be inserted into a ferrule 42, and the combination is retained by a clamp 44 (see also FIG. 2). In an embodiment, the tube 40 may be made of a material, such as aluminum or copper, that is softer and more malleable than the material of the spherical roller 34. In an embodiment, the ferrule 42 may be made of a material less malleable than that of the tube 40, such as stainless steel.

Figure 3:
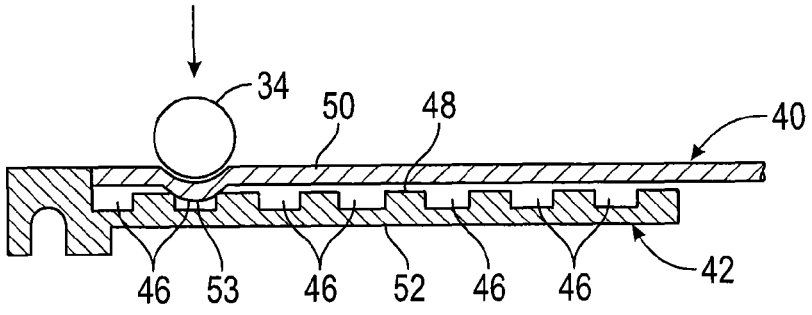
FIG. 3 is a detail of the apparatus of FIG. 1 showing the spherical roller deforming a tube end into a groove of a ferrule.

As shown in FIGS. 1 and 2, the operation of the roller swage 10 is as follows. Tube 40 may be inserted into an end of the ferrule 42. As shown in FIG. 3, the ferrule 42 may be shaped to have a plurality of annular recesses 46 extending about an interior wall 48. In an embodiment, the annular recesses may have a thickness (measured in the direction of axis B) of 0.045-0.05 inches and a depth of between 0.01-0.24 inches. The tube 40 may have a thickness of between 0.032-0.06 inches.

The ferrule 42 and tube 40 may be held securely in the clamp 44 so that the centers of the ferrule 42 and tube 40 may coincide with central axis B, as shown in FIG. 2. The control 38 may activate actuator 16 to displace the actuator 18 along slide 14 in the direction of arrow A (to the right in FIG. 1) and parallel to axis B. This motion may move the support arm 28 such that the axial component 32 enters the end of tube 40 and ferrule 42. The control 38 may stop the longitudinal motion of the actuator 18 and support arm 28 when the spherical roller 34 is positioned on a radius that is aligned with one of the annular recesses 46 (FIG. 3).

At this point, the actuator 18 is activated by control 38 and begins to rotate the mount 20, causing the spherical roller 34 to describe the circular path D, shown in FIGS. 1 and 2. Simultaneously, or in an embodiment subsequently, actuator 26 may be activated by control 38, causing support arm 28 to travel in a radial direction outwardly from axis B in the direction of arrow C in FIG. 1. This radial motion brings the spherical roller 34 into contact with an inner wall 50 of the tube 40 (FIG. 3). Continued movement of the support arm 28 causes the spherical roller 34 to deform the wall 50 to form an annular bulge 53 into a radially adjacent one of the annular recesses 46, as shown in FIG. 3. In embodiments, the control 38 may activate the actuator 26 to form an annular bulge 53 that may extend the entire length of the annular recess 46 (i.e., the entire circumference of inner wall 50), or only a portion or portions of the annular recess.

After the spherical roller 34 has described at least one complete circular path D, the actuator 26 may be activated by control 38 to draw the support arm 28 radially inwardly toward axis B, thereby causing the spherical roller 34 to disengage from the inner wall 50 of the tube 40.

The control 38 may then activate actuator 16 to displace actuator 18 and mount 20 further along axis B, thereby displacing spherical roller 34 to a next one of the annular recesses 46. There, the process may begin a subsequent time in which the actuator 26 displaces the support arm 28 radially outwardly from the axis B to bring the spherical roller 34 into contact with the inner surface 50 of the tube 40 to deform the tube into the adjacent annular recess, and the actuator 18 is activated by control 38 to cause the support arm 28 to describe a circular path D that coincides with the annular recess 46. This process may be repeated as many times as is desired or required to effect a mechanical lock between the tube 40 and ferrule 42 in which the wall of the tube 40 is deformed into one or more annular recesses 46 of the ferrule 42. Because the ferrule 42 is held within the clamp 44, deformation of the ferrule 42 by this process may be minimized because the spherical roller 34 urges against the tube 40 and the ferrule 42, but the outer wall 52 of the ferrule 42 is held by the clamp 44.

Figure 4:
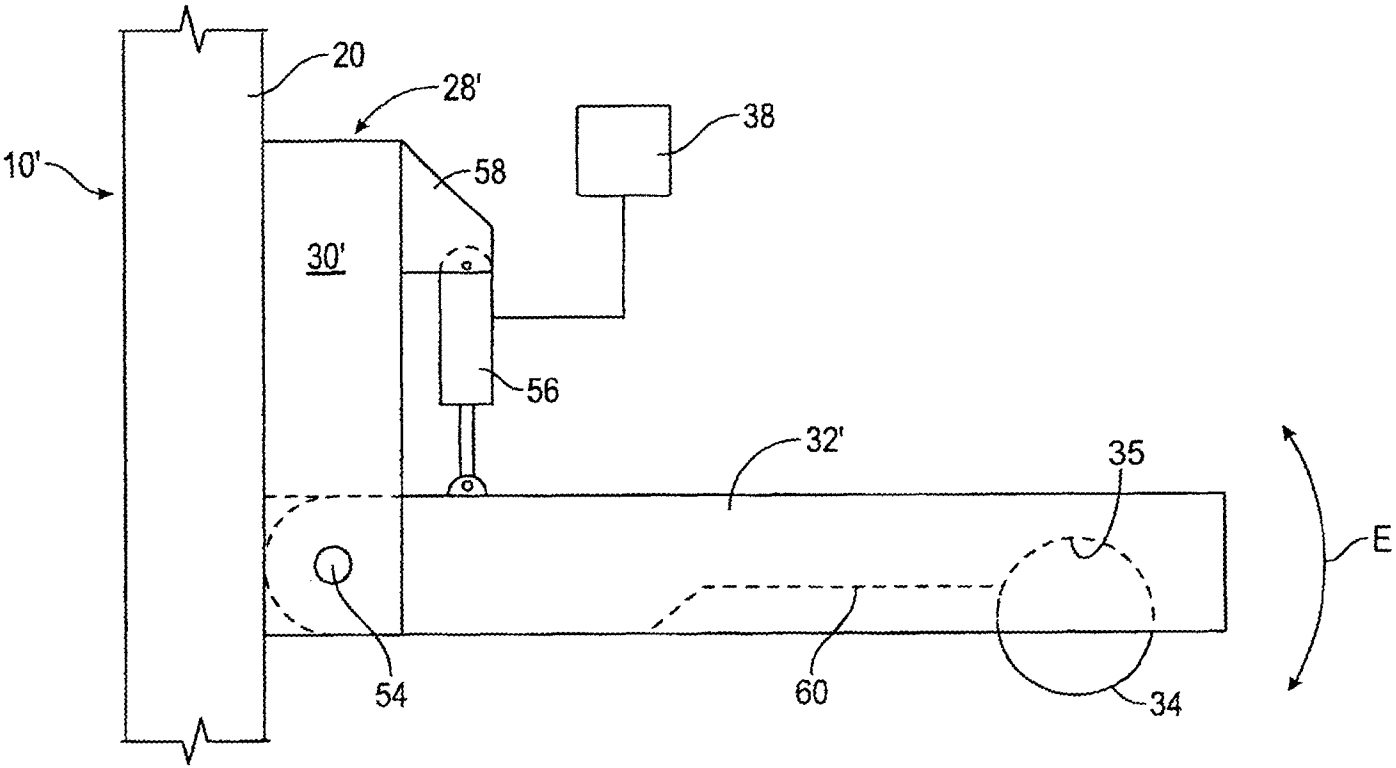
FIG. 4 is a detail showing an alternate embodiment of the roller swage.

In an alternate embodiment, shown in FIG. 4, the roller swage 10' may include a mount 20 that slidably supports a support arm 28'. Support arm 28' may include a radial component 30' and an axial component 32' that is connected to radial component 30' by a pivot 54. Support arm 28' may include an actuator 56 that is pivotally connected to the axial component 32 and to the radial component 30' by a bracket 58. Controller 38 may be connected to activate actuator 56 to impart pivotal movement of the axial component 32' in the direction of arrow E. This pivotal movement in the direction of arrow E causes the spherical roller 34 to move in a radial direction relative to axis B (FIGS. 1 and 2), thereby causing the spherical roller to move toward and away from the inner surface of the wall 50 of the tube 40 when axial component 32' is inserted into the ferrule 42 and tube 40 during a swaging operation.

In yet another embodiment, the axial component 32' (or the axial component 32 shown in FIG. 1) may include a lubrication channel 60 connected to a source of lubricant that may be under pressure (not shown) to convey lubricant to the recess 35 that receives the spherical roller 34.

As is apparent from the foregoing embodiments, the disclosed swaging method and apparatus may be capable of swaging tubes to ferrules of a wide variety of diameters. Further, because the swaging force is concentrated at a single point, namely the point of contact of the spherical roller 34 against wall 50, much less force is required to deform the tube 40 to form bulge 53 into recess 46, so that deformation of the tube and ferrule from a round condition is minimized in comparison to prior art devices that may employ tapered rollers. A further advantage over prior art devices is that the mechanical deformation effected by the apparatus 10, 10' may be varied; specifically, the apparatus may be used to deform the tube wall 40 into a single cylindrical recess 46, or a plurality of cylindrical recesses, thereby varying the degree of mechanical interlock between the ferrule and the tube.

While the methods and forms of apparatus herein described constitute preferred embodiments of the disclosed roller swage method and apparatus, it is to be understood that variations may be made therein without departing from the scope of the invention.

What is claimed is:

1. An apparatus for roller swaging, the apparatus comprising:

a support arm having a radial component and an axial component;

a spherical roller attached to an end of the axial component of the support arm for relative rotational movement;

a mount slidably supporting the radial component of the support arm for movement of the radial component and the axial component in a radial direction relative to a central axis of rotation of the mount;

a first actuator mounted on the mount for displacing the radial component and the axial component of the support arm relative to the mount;

a linear slide;

a second actuator mounted on the linear slide, the second actuator having an axle that supports the mount and imparts rotational movement to the mount about the central axis of rotation in which the spherical roller describes a circular path;

a third actuator connected to the second actuator such that the third actuator displaces the second actuator in a linear direction on the linear slide; and a control connected to activate the third actuator to displace the second actuator along the linear slide to move the support arm into an end of a tube, the second actuator to rotate the mount, causing the support arm to describe a circular path, and the first actuator to cause the support arm to travel in a radial direction outwardly from the central axis of rotation to bring the spherical roller into contact with the tube to form an annular bulge in the tube.

2. The apparatus of claim 1, further comprising a base for supporting the linear slide and the second actuator for reciprocal movement along the central axis of rotation; and the base supporting the third actuator.

3. The apparatus of claim 1, wherein the spherical roller protrudes from the support arm in a direction away from the central axis of rotation.

4. The apparatus of claim 1, wherein the support arm is shaped to be inserted into an end of the tube inserted into a ferrule.

5. The apparatus of claim 1, further comprising a clamp adapted to engage and hold a ferrule centered relative to the central axis of rotation.

6. The apparatus of claim 1, wherein the support arm includes a lubrication channel for conveying a lubricant to the spherical roller.

7. The apparatus of claim 1, wherein the support arm includes a spherical recess shaped to receive and retain the spherical roller therein.

8. The apparatus of claim 1, wherein the spherical roller is received in the support arm at an end distal from the mount.

9. The apparatus of claim 1, wherein the spherical roller is made from one of titanium and stainless steel.

10. An apparatus for roller swaging, the apparatus comprising:

a clamp adapted to hold a ferrule having a grooved interior surface fitted over an end of a tube;

a support arm extending in a direction parallel to an axis passing through a center of the ferrule;

a spherical roller rotatably supported in the support arm;

a mount adapted to receive the support arm for relative slidable movement in a radial direction relative to the axis;

a first actuator connected to displace the support arm relative to the mount;

a second actuator connected to support the mount and impart rotational movement to the mount about a central axis in which the spherical roller describes a circular path;

a base connected to support the second actuator for reciprocal movement parallel to the axis;

a third actuator connected to the second actuator for displacing the second actuator relative to the base; and a controller configured to operate the first actuator, the second actuator and the third actuator in a sequence in which the third actuator displaces the second actuator to place the support arm into the ferrule and align the spherical roller with a first groove of the ferrule, then the first actuator displaces the support arm radially outward from the axis such that the spherical roller deforms a portion of the tube end into the first groove, then the second actuator rotates the arm such that the spherical roller displaces the portion of the tube end along the first groove, then activates the first actuator to displace the support arm radially inward toward the axis, then activates the third actuator to displace the second actuator to align the spherical roller with a second groove of the ferrule to repeat the sequence.

11. A method for roller swaging, the method comprising:

inserting an end of a tube into a ferrule;

activating a first actuator to displace a second actuator along a linear slide to move an axial component of a support arm into the end of the tube;

activating the second actuator to rotate a mount, the second actuator having an axle that supports the mount and causes the axial component of the support arm to describe a circular path about a central axis of rotation of the mount;

activating a third actuator to cause the axial component and a radial component of the support arm slidably mounted on the mount to travel in a radial direction relative to the mount outwardly from the central axis of rotation to bring a spherical roller, attached to the support arm for relative rotational movement, into contact with the tube to form an annular bulge in the tube against the ferrule and thereby mechanically secure the ferrule to the end of the tube.

12. The method of claim 11, further comprising moving the spherical roller in a circular path within the end of the tube and thereby mechanically secure the ferrule to the end of the tube about an interior circumference thereof.

13. The method of claim 12, further comprising moving the spherical roller in the circular path at a plurality of positions within the end of the tube.

14. The method of claim 11, further comprising holding the ferrule in a fixed position as the spherical roller is urged against the inner wall of the tube.

15. The method of claim 11, further comprising clamping the ferrule and tube in position as the spherical roller is urged against the inner wall of the tube.

16. A method for roller swaging, the method comprising:

inserting an end of a metal tube into a ferrule, the ferrule having at least one annular recess formed in an inner surface thereof;

positioning a spherical roller radially inwardly of the annular recess and an inner wall of the tube relative to a center of the ferrule;

simultaneously urging the spherical roller radially outward against the inner wall of the tube with a force sufficient to deform the tube into the annular recess, and moving the spherical roller in a circular path whereby a portion of the tube is deformed into the annular recess; and subsequent to the step of simultaneously urging the spherical roller radially outward and moving the spherical roller in a circular path:

moving the spherical roller radially inward to disengage from the inner wall of the tube;

displacing the spherical roller in a direction parallel to the axis of the ferrule until the spherical roller is positioned radially inward of a second annular recess of the ferrule; and simultaneously urging the spherical roller radially outward against the inner wall of the tube with a force sufficient to deform the tube into the second annular recess, and moving the spherical roller in a circular path whereby a portion of the tube is deformed into substantially an entirety of the second annular recess.

17. An apparatus for roller swaging, the apparatus comprising:

a mount;

a support arm, the support arm having a radial component attached to the mount and an axial component;

a first actuator mounted on the radial component for displacing the axial component in a radial direction relative to the mount and the radial component;

a second actuator supporting the mount and imparting relative rotational movement to the mount about a central axis of rotation;

the radial component extending in a direction perpendicular to the central axis of rotation with the axial component attached to an outer radial end of the radial component and extending in a direction parallel to the central axis of rotation; and a spherical roller attached to the end of the axial component of the support arm distal from the mount, the spherical roller describing a circular path about the central axis of rotation in response to the relative rotational movement of the mount by the second actuator.

18. The apparatus of claim 17, wherein the axial component is pivotally attached to the radial component.

19. The apparatus of claim 18, wherein the first actuator is connected to pivot the axial component relative to the radial component such that the spherical roller moves in a radial direction.

* * * * *